United States Patent [19]

Chance et al.

[11] 3,932,123

[45] Jan. 13, 1976

[54] FLAMEPROOFING OF COTTON CELLULOSE WITH HEXAMETHYL PHOSPHOROUS TRIAMIDE

[75] Inventors: Leon H. Chance, New Orleans; Armand B. Pepperman, Jr., Metairie, both of La.

[73] Assignee: The United States of America as represented by the Secretary of Agriculture, Washington, D.C.

[22] Filed: Mar. 16, 1973

[21] Appl. No.: 342,136

[52] U.S. Cl. ..... 8/116 P; 8/181; 252/8.1

[51] Int. Cl.[2] ..... D06M 1/00; D06M 13/34; B27K 3/00; C09K 3/00

[58] Field of Search ..... 8/116 P, 194, 181, 183, 8/185, 196; 252/8.1

[56] References Cited

UNITED STATES PATENTS

| | | | |
|---|---|---|---|
| 3,068,060 | 12/1962 | Emmons | 8/194 |
| 3,503,793 | 3/1970 | Brandeis | 117/136 |
| 3,632,297 | 1/1972 | Sello | 8/194 |
| 3,666,401 | 5/1972 | Cahill | 8/116 P |
| 3,666,402 | 5/1972 | Meyers | 8/116 P |
| 3,712,789 | 1/1973 | Linderman | 8/116 P |
| 3,715,185 | 2/1973 | Meyers | 8/116 P |

OTHER PUBLICATIONS

"Reaction of Hexamethylphosphorous Triamide W/Cotton Cellulose" A. B. Pepperman, Jr., J. of Applied Polymer Sci., Vol. 16, pp. 1833–1838.

E. E. Nifant'ev, Zh. Obshcn. Khim, 36, 765 (1966).

Organo Phosphorus Monomers & Polymers; E. L. Gefter, 1962; Associated Technical Services, Inc. pp. 189–191.

Jones & Noone, J. Appl. Chem., 12, Sept. 1962, pp. 397–405.

*Primary Examiner*—Leland A. Sebastian
*Assistant Examiner*—Donald P. Walsh
*Attorney, Agent, or Firm*—M. Howard Silverstein; Max D. Hensley

[57] ABSTRACT

Hexamethyl phosphorous triamide is reacted with cotton cellulose, thereby imparting flame retardancy and cationexchange properties to the cellulose.

7 Claims, No Drawings

FLAMEPROOFING OF COTTON CELLULOSE WITH HEXAMETHYL PHOSPHOROUS TRIAMIDE

A non-exclusive, irrevocable, royalty-free license in the invention herein described, throughout the world for all purposes of the United States Government, with the power to grant sublicenses for such purposes, is hereby granted to the Government of the United States of America.

The present invention relates to processes for making cellulosic materials flame retardant and cation exchangeable by the chemical reaction of said cellulosic materials with hexamethyl phosphorous triamide having the following graphic formula:

$$[(CH_3)_2N\rightarrow]_3P$$

The main object of the invention is to provide processes for imparting improved flame retardancy to cotton and other cellulosic textiles.

It has been shown by several workers [Petrov, et al., Zhur Obshchei Khim, 31, 2377–80, (1961); Houalla, et al., Bull. Soc. Chim. France, 1965, 2368–73; Vetter and Noeth, Ber., 96, 1308-15 (1963); Burgada, Ann. Chim. 8, 347–81 (1963); Nifant'ev et al., Zhur Obshch Khim, 36, 765, (1966)] that phosphorous amides and phosphoramidous acids react with alcohols to produce the corresponding esters. It has been further shown that dialkyl phosphorous amides [Emmons and Wadsworth, U.S. Pat. No. 3,068,060] and tetraalkylphosphorous amides [Jones and Noone, J. Appl. Chem., 12, 397–405 (1962)] will react with cellulose. These reactions were always considered as occurring by displacement of an $-NH_2$or $-Cl$ group and not by displacement of a dialkylamino group ($R_2N-$). No one has examined the reactions of cellulose with hexaalkyl phosphorous triamides.

We have discovered that the dimethylamino group can be replaced by reaction with cellulose to yield a product illustrated by the following formula:

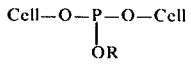

Where R is H in 79% to 93% of the ester molecules and R is Cell in 7% to 21% of the ester molecules. This trivalent phosphorus ester is readily susceptible to oxidation and during the air drying step the phosphine oxide is produced.

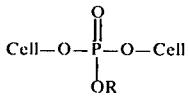

We have also discoverd that the cellulose product of this invention has cation exchange properties and is thereby capable of exchanging hydrogen for metal ions or ammonium ions ($NH_4^+$). Certain of the metal ions, and in particular the $NH_4^+$ ion, enhance the flame retardance of the phosphorus containing cellulosic material.

The reaction proceeds moderately at room temperature, about 25°C, but can be speeded up by heating. The reaction with cellulosic textiles will occur in the neat hexamethyl phosphorus triamide, hereinafter referred to as HPT, or in chlorinated solvents such as chloroform or in amides such as dimethylformamide. The HPT can also be applied to cellulosic textiles by conventional methods used for padding textiles and then the textiles heated in an oven to effect reaction.

We have also discovered that it is advantageous to use an acid catalyst to improve the efficiency and increase the rate of the reaction of HPT with cellulosic materials. Catalysts particularly suitable for this reaction are latent acid catalysts of the amine salt type, such as dimethylamine hydrochloride and diethylamine hydrochloride.

The process has the advantage of adding almost pure phosphorus to the cellulosic textile under basic conditions so that strength loss in minimal. There is cross-linking of the cellulose as evidenced by insolubility in aqueous 0.5 molar cupriethylenediamine hydroxide, hereinafter abbreviated "cuene."

Although cotton cellulose is the preferred material for use in this invention, other suitable cellulosic materials include paper, flax, ramie, and regenerated cellulose. The cellulosic fibrous material may suitably contain non-cellulosic materials such as nitrogenous resins or even be blended with other fibers such as polyester or nylon in a textile structure.

In accordance with the present invention the reaction of cotton cellulose with HPT may be conveniently carried out by treating the cotton with neat HPT at about from room temperature to 120°C for periods of time about from 5 minutes to 90 minutes.

Alternatively, the reaction of HPT with cotton may be carried out in an organic solvent such as chloroform or dimethylformamide at temperatures ranging about from room temperature to 120°C for periods of time ranging about from 5 minutes to 90 minutes.

Another alternative method of reacting HPT with cotton involves applying the HPT to the cotton either neat or in a suitable solvent by the use of a textile padder, and finally heating the cotton in an oven to effect reaction.

Still another alternative is to treat the cotton with a nitrogenous resin such as trimethylol melamine, or ureaformaldehyde type resins. The nitrogenous resins may be applied to the cotton either before treatment with HPT or after treatment with HPT. Nitrogen acts synergistically with phosphorus in making cellulosic materials flame retardant.

Flame retardancy of cotton textiles produced by the processes of this invention was tested by the strip angle flame test described in the following reference: Reeves, W. A., McMillan, Jr., O. J., and Guthrie, J. D., Textile Research J., 23, 527–32 (1953).

The following examples illustrate but do not limit the scope of this invention.

EXAMPLE 1

Covered 0.84 g of 8 oz white cotton sateen with 8 g of neat HPT in a beaker covered with parafilm. The fabric was cut in small strips and the mixture of fabric and HPT stirred at room temperature for 1 hour. The fabric was then rinsed in $CHCl_3$ to remove unreacted HPT for 5 minutes and then rinsed in running hot water for 30 minutes. The air-equilibrated fabric contained 0.50% phosphorus.

EXAMPLE 2

Treated about 1 g of 8 oz white cotton sateen in approximately 10 g of neat HPT. The container was a microware reaction kettle fitted with a condenser and a gas inlet tube for argon. A slight positive pressure of inert gas was maintained throughout the reaction. The fabric was covered by the HPT which was warmed by a water bath at 80°C for ninety minutes. The rinsing procedure as in Example 1 was followed. The equilibrated fabric contained 2.23% phosphorus.

EXAMPLE 3

Neat HPT was padded onto white cotton sateen (8 oz) at 75 psi to give approximately 60% wet pickup. The sample was divided into three parts and each heated 5 minutes at different temperatures. Results are shown in Table I.

TABLE I

| Cure temperature | % Phosphorus | % Nitrogen | Flame test strip angle |
|---|---|---|---|
| 85°C | 1.19 | 0.10 | 50° |
| 120°C | 1.34 | 0.10 | 50° |
| 155°C | 1.01 | — | 50° |

From the flame test it is evident that the fabric had improved flame retardancy since untreated cotton has a strip angle of 0°.

EXAMPLE 4

A 40% solution of HPT in dimethylformamide was prepared and used in treating a series of samples of white cotton sateen (8 oz). The samples were coiled and immersed in the solution at 110° or 150°C in the container described in Example 2. Typical results are shown in Table II.

Table II

| Reaction temperature | Reaction Time | % Phosphorus | % Nitrogen | Flame test strip angle |
|---|---|---|---|---|
| 110°C | 5 min. | 1.57 | 0.36 | 90° |
| 110°C | 40 min. | 1.94 | 0.20 | 105° |
| 150°C | 5 min. | 0.86 | 0.47 | 75° |
| 150°C | 30 min. | 1.73 | 0.61 | 90° |

EXAMPLE 5

Six hundred grams of 40% hexamethyl phosphorus triamide (HPT) in dimethyl formamide (DMF) was prepared. This was transferred to a reaction cylinder which was wrapped with heating tape to produce a temperature of 110°C in the solution. The solution was stirred by bubbling argon through it from a gas inlet tube in the bottom of the cylinder.

Samples of cotton fabric were cut in 6 inch ×12 inch rectangles and lowered into the heated solution. Both 8 oz cotton sateen and 3 oz cotton printcloth (abbreviated P.C.) were used. Reaction was carried out for the times shown in Table III. The fabric samples were then rinsed in 2½ l. of $CHCl_3$ for 10 minutes to remove unreacted HPT and then washed in running hot water for 30 minutes. The physical and chemical properties were determined on the air-dried samples. A catalytic amount of dimethylamine hydrochloride (1%), (abbreviated DMA. HCl), was used on samples 5–8. The cation exchange values were determined by the method of Hoffpauir and Guthrie [Textile Res. J. 20, p. 617–620 (1950)].

TABLE III

Chemical Properties of HPT Fabrics

| Sample No. | Fabric Type | Time of Treatment | Catalyst | Match Test angle | % P | Meq of exchanger per kg (dry basis) |
|---|---|---|---|---|---|---|
| 1 | P.C. | 10 min. | None | ~10° | 1.69 | 430.3 |
| 2 | P.C. | 30 min. | None | ~50° | 1.93 | 515.9 |
| 3 | Sateen | 10 min. | None | ~90° | 1.80 | 507.3 |
| 4 | Sateen | 30 min. | None | ~90° | 2.24 | 601.3 |
| 5 | P.C. | 5 min. | DMA.HCl | ~10° | 1.64 | 401.6 |
| 6 | P.C. | 15 min. | DMA.HCl | ~70° | 2.06 | 556.9 |
| 7 | P.C. | 5 min. | DMA.HCl | ~85° | 1.47 | 421.9 |
| 8 | P.C. | 15 min. | DMA.HCl | ~100° | 2.08 | 584.6 |

The samples were all treated in the same solution so there was some depletion of HPT with each sample. However, the catalytic effect of DMA.HCl can be seen since only half the reaction time is necessary to give essentially the same phosphorus add-on. Also, the experiments using the catalyst were run after some depletion of HPT had occurred. The cation exchange values are quite high being on the order of 40–50% of that obtained for cellulose which has been phosphorylated with phosphoric acid (based on 1st hydrogen).

The breaking strength retention of all of the fabric samples was good, varying from a gain of 7.4% to a loss of only 13.8%.

EXAMPLE 6

The maximum effect of the DMA.HCl catalyst was not obtained in Example 5 because the HPT in the DMF solution had been partially depeleted before the catalyst was added.

Therefore, another experiment was conducted in which two separate solutions were used - one without the catalyst and one with the catalyst.

Three samples of 8 ounce white cotton sateen (2½ inch ×5 inch) were treated in the same manner as in Example 2 at 110°C for varying time periods in a 40% solution of HPT (by weight) in DMF.

A fresh solution was prepared containing 40% HPT and 1% DMA·HCl (by weight) in DMF. The DMA·HCl dissolved when the solution was heated. Three additional samples of cotton sateen were treated under the same conditions as the first three samples.

The results on flame retardancy and phosphorus content of the cotton samples are shown in Table IV.

TABLE IV

| Sample No. | Reaction Time (minutes) | Catalyst | Match test angle degrees | % P |
|---|---|---|---|---|
| 1 | 5 | none | 120° | 1.33 |
| 2 | 10 | none | 110° | 1.72 |
| 3 | 20 | none | 110° | 1.91 |
| 4 | 5 | DMA.HCl | >135° | 2.74 |
| 5 | 10 | DMA.HCl | >135° | 3.26 |
| 6 | 20 | DMA.HCl | 180° | 3.65 |

Much better flame retardancy was obtained in a shorter reaction time than was obtained on the samples shown in Table III of Example 5.

EXAMPLE 7

One-hundred grams of trimethylol melamine (TMM) solution containing 7, 10, and 13% TMM were prepared. Each solution contained also 1% of a citric acid-magnesium chloride hexahydrate mixed catalyst and 1% of Triton X-100 wetting agent. Two samples of cotton printcloth (abbreviated P.C.) and sateen were padded through the solution to about 90% wet pick-up, dried 4 minutes at 85°C and cured 4 minutes at 155°C. The cured sample was washed in running hot tap water for 30 minutes and then the sample air-dried. One of the samples at each TMM level was then treated with HPT by the procedure described in Example 5.

The HPT treatment was for 20 minutes at 110°C. The results of this dual treatment are shown in Table V.

TABLE V

| Sample No. | Properties of Fabric Treated with TMM, then HPT: % TMM in pad bath | % Add-on | % Nitrogen | % Phosphorus | Match Test Angle, degrees | Fabric Type |
|---|---|---|---|---|---|---|
| 1 | 7 | 5.3 | 2.86 | 0.41 | 0 | P.C. |
| 2 | 7 | 5.1 | 2.37 | | | P.C. |
| 3 | 7 | 3.2 | 1.68 | 0.85 | 90° | Sateen |
| 4 | 7 | 2.9 | 2.12 | | | Sateen |
| 5 | 10 | 7.7 | 3.87 | 0.52 | 45° | P.C. |
| 6 | 10 | 7.8 | 3.58 | | | P.C. |
| 7 | 10 | 6.3 | 3.29 | 0.69 | 90° | Sateen |
| 8 | 10 | 6.2 | 3.23 | | | Sateen |
| 9 | 13 | 11.1 | 5.16 | 0.40 | 45° | P.C. |
| 10 | 13 | 10.5 | 5.03 | | | P.C. |
| 11 | 13 | 7.8 | 3.86 | 0.52 | 90° | Sateen |
| 12 | 13 | 8.1 | 4.15 | | | Sateen |

It is readily apparent that by adding a nitrogenous resin such as TMM to the cotton that flame retardancy can be obtained at a much lower phosphorus content. For example, sample No. 4 in Table III contained 2.24% phosphorus but no nitrogen and had a 90° match test angle, whereas sample No. 1 in Table V contained only 0.52% phosphorus and 3.86% nitrogen and also had a match test angle of 90°.

EXAMPLE 8

Two samples of cotton sateen which had been treated previously with HPT and which had match test angles of 110° were treated with 7% and 10% TMM, respectively, as in Example 7. Both samples had match test angles greater than 135°.

Thus Examples 7 and 8 illustrate that flame retardancy can be improved by applying TMM either before or after treatment with HPT.

EXAMPLE 9

A sample of cotton sateen which had been treated with HPT and which had a match test angle of 110° was soaked in 2% ammonium hydroxide and then dried to remove excess ammonia. The flame retardancy was greatly improved, as shown by an increase in the match test angle to 180°. This treatment illustrates the ability of the HPT treated fabric to exchange cations.

We claim:

1. A process for producing a flame resistant and cation exchangeable cellulosic material which process comprises crosslinking a cellulosic material by reacting said material with hexamethylphosphorus triamide and allowing the phosphorus ester crosslinking of said material to take place at a temperature ranging from room temperature to about 120°C. for a period of about 5 minutes to 90 minutes.

2. The process of claim 1 wherein the hexamethylphosphorus triamide is dissolved in dimethylformamide.

3. The process of claim 1 wherein the hexamethylphosphorus triamide is dissolved in a chlorinated solvent.

4. The process of claim 2 wherein the reaction is catalyzed by a latent acid catalyst.

5. The process of claim 4 wherein the reaction is catalyzed by dimethylamine hydrochloride.

6. The process of claim 1 wherein the cellulosic material contains a cured nitrogenous resin.

7. A process for producing a flame-resistant and cation exchangeable cellulosic material, which process comprises reacting a cellulosic material with a solution consisting essentially of hexamethylphosphorus triamide and solvent, and allowing the reaction to take place at a temperature ranging from room temperature to about 120° C. for a period of about 5 minutes to 90 minutes.

* * * * *